US011387027B2

(12) United States Patent
Lefebvre et al.

(10) Patent No.: US 11,387,027 B2
(45) Date of Patent: Jul. 12, 2022

(54) RADIAL MAGNETIC CIRCUIT ASSEMBLY DEVICE AND RADIAL MAGNETIC CIRCUIT ASSEMBLY METHOD

(71) Applicant: SHENZHEN GRANDSUN ELECTRONIC CO., LTD., Shenzhen (CN)

(72) Inventors: Mickael Bernard Andre Lefebvre, Shenzhen (CN); Gang Xie, Shenzhen (CN); Haiquan Wu, Shenzhen (CN); Weiyong Gong, Shenzhen (CN); Ruiwen Shi, Shenzhen (CN)

(73) Assignee: SHENZHEN GRANDSUN ELECTRONIC CO., LTD., Shenzhen (CN)

( * ) Notice: Subject to any disclaimer, the term of this patent is extended or adjusted under 35 U.S.C. 154(b) by 523 days.

(21) Appl. No.: 16/491,313

(22) PCT Filed: Dec. 5, 2017

(86) PCT No.: PCT/CN2017/114625
§ 371 (c)(1),
(2) Date: Sep. 5, 2019

(87) PCT Pub. No.: WO2018/161659
PCT Pub. Date: Sep. 13, 2018

(65) Prior Publication Data

US 2020/0075208 A1 Mar. 5, 2020

(30) Foreign Application Priority Data

Mar. 6, 2017 (CN) ..... 201710127837.6
Mar. 6, 2017 (CN) ..... 201720214246.8

(51) Int. Cl.
*H01F 7/02* (2006.01)
*H04R 9/02* (2006.01)
*H04R 31/00* (2006.01)

(52) U.S. Cl.
CPC ..... *H01F 7/021* (2013.01); *H04R 9/025* (2013.01); *H04R 31/006* (2013.01)

(58) Field of Classification Search
CPC ..... H01F 7/021; H04R 9/025; H04R 31/006; H04R 31/00
See application file for complete search history.

(56) References Cited

U.S. PATENT DOCUMENTS 5,321,762 A * 6/1994 Stuart ..... H04R 9/025 381/420
6,047,077 A 4/2000 Larsen
(Continued)

FOREIGN PATENT DOCUMENTS

CN 203279164 U 11/2013
CN 106375915 A 2/2017
(Continued)

OTHER PUBLICATIONS

Translation of International Search Report and Written Opinion dated Feb. 24, 2018 in corresponding International application No. PCT/CN2017/114625; 9 pages.

*Primary Examiner* — Angelica M McKinney
(74) *Attorney, Agent, or Firm* — Maier & Maier, PLLC

(57) ABSTRACT

A radial magnetic circuit assembly device includes a magnetic central column, a lower lantern ring and an upper lantern ring, the magnetic central column includes a large-diameter section and a small-diameter section which form a limit step on which each tile-shaped magnet is annularly and uniformly arranged, the lower lantern ring is sleeved on the tile-shaped magnet in a direction from the large-diameter section towards the small-diameter section and is configured
(Continued)

to limit a radial displacement of each tile-shaped magnet, the upper lantern ring is sleeved on the tile-shaped magnet in a direction from the small-diameter section towards the large-diameter section to press the upper axial magnetic sheet and the lower axial magnetic sheet against the upper axial side surface and the lower axial side surface of each tile-shaped magnet respectively.

12 Claims, 6 Drawing Sheets

(56) References Cited

U.S. PATENT DOCUMENTS

| | | | | |
|---|---|---|---|---|
| 2007/0160257 | A1* | 7/2007 | Stiles ..... | H04R 9/025<br>381/407 |
| 2015/0326960 | A1 | 11/2015 | Niedermann et al. | |

FOREIGN PATENT DOCUMENTS

| | | | | |
|---|---|---|---|---|
| CN | 107027088 | A | | 8/2017 |
| CN | 206575611 | U | | 10/2017 |
| CN | 208836404 | U | * | 5/2019 |
| CN | 213818171 | U | * | 7/2021 |
| EP | 1482762 | A2 | | 12/2004 |

* cited by examiner

RADIAL MAGNETIC CIRCUIT ASSEMBLY DEVICE AND RADIAL MAGNETIC CIRCUIT ASSEMBLY METHOD

FIELD

The present disclosure relates to the technical field of trumpet production equipments, and more particularly to a radial magnetic circuit assembly device and a radial magnetic circuit assembly method.

BACKGROUND

With the continuous improvements of living levels, listening to music has become an approach of relieving mood and relieving pressure when people gets free from the work and has leisure time. Meanwhile, with the continuous pursuit of people on high-quality life, quality requirements on sounding elements such as earphones, trumpets and the like are becoming higher and higher. In order to enable each user to listen to true pure sound in life in a noisy environment, the manufacturer has a higher and higher requirement on a low-distortion of a trumpet when viewing from the starting point of humanistic care and health concept, where a miniature trumpet with the magnetic circuit structure designed by using the magnet as the upper magnetic conductive sheet and the lower magnetic conductive sheet has a better magnetic field uniformity characteristic as compared to the traditional miniature trumpet magnetic circuit structure; due to this design, the distribution of the magnetic line of force is uniformly distributed and symmetric, the magnetic flux leakage is small, and thus the distortion of the trumpet may be greatly reduced. However, for a long time, a radial magnet is prone to be subjected to a repulsive force of the upper and lower pieces of magnets, such that the radial magnet is difficult in processing and a batch production of radial magnets is unenforceable; moreover, a large amount of manpower and assembly cost are spent.

SUMMARY

An objective of the present disclosure is that: in one aspect, providing a radial magnetic circuit assembly device, which aims at solving a technical problem in the prior art that it is difficult to assemble and process a radial magnetic circuit and the cost is high;

in another aspect, providing a radial magnetic circuit assembly method, which aims at solving a technical problem in the prior art that it is difficult to assemble and process a radial magnetic circuit and the cost is high.

In order to solve the aforesaid technical problems, the technical solutions adopted by the present disclosure are as follows:

in one aspect, a radial magnetic circuit assembly device is provided, the radial magnetic circuit assembly device is configured to mount an upper axial magnetic sheet and a lower axial magnetic sheet respectively on an upper axial side surface and a lower axial side surface of each of a plurality of tile-shaped magnets and includes: a magnetic central column, and a lower lantern ring and an upper lantern ring sleeved on the magnetic central column, where the magnetic central column includes a large-diameter section and a small-diameter section connected in sequence, a joint of the large-diameter section and the small-diameter section is provided with a limit step on which each tile-shaped magnet is annularly and uniformly arranged, the lower lantern ring is sleeved on the tile-shaped magnet in a direction from the large-diameter section towards the small-diameter section and is configured to limit a radial displacement of each tile-shaped magnet, and the upper lantern ring is sleeved on the tile-shaped magnet in a direction from the small-diameter section towards the large-diameter section to press the upper axial magnetic sheet and the lower axial magnetic sheet against the upper axial side surface and the lower axial side surface of each tile-shaped magnet respectively.

Preferably, one end of the lower lantern ring is provided with a sealing plate, and one end of the large-diameter section abuts against an inner side of the sealing plate.

Preferably, the radial magnetic circuit assembly device further includes a sleeve configured to push the upper axial magnetic sheet and the tile-shaped magnet that have been assembled out of the small-diameter section, and to push the upper axial magnetic sheet, the lower axial magnetic sheet and the tile-shaped magnet that have been assembled out of the small-diameter section.

Preferably, the lower lantern ring is a non-metal lower lantern ring, and the upper lantern ring is a non-metal upper lantern ring.

Preferably, the lower lantern ring is a plastic lower lantern ring, and the upper lantern ring is a plastic upper lantern ring.

Preferably, the magnetic central column is a soft magnetic central column.

Preferably, the magnetic central column is a low carbon steel magnetic central column.

In a second aspect, a radial magnetic circuit assembly method is provided, the radial magnetic circuit assembly method includes following steps of:

S1, providing a magnetic central column, where the magnetic central column comprises a large-diameter section and a small-diameter section connected in sequence, and a limit step is formed at a joint of the large-diameter section and the small-diameter section;

S2, providing a lower lantern ring, annularly and uniformly arranging a plurality of tile-shaped magnets on the limit step firstly, and then sleeving the lower lantern ring around the tile-shaped magnet in a direction from the large-diameter section towards the small-diameter section to limit a radial displacement of each tile-shaped magnet; or alternatively, sleeving the lower lantern ring around the large-diameter section in a direction from the large-diameter section towards the small-diameter section, and then annularly and uniformly arranging each tile-shaped magnet in a space formed between the limit step and the lower lantern ring, such that the lower lantern ring limits a radial displacement of each tile-shaped magnet;

S3, providing an upper lantern ring, sleeving an upper axial magnetic sheet around the small-diameter section firstly, and then sleeving the upper lantern ring around the tile-shaped magnet in the direction from the small-diameter section towards the large-diameter section to press the upper axial magnetic sheet against an upper axial side surface of each tile-shaped magnet, such that the upper axial magnetic sheet is secured with each tile-shaped magnet;

S4, pushing the upper axial magnetic sheet and each tile-shaped magnet that have been assembled out of the small-diameter section;

S5, turning over the upper axial magnetic sheet and each tile-shaped magnet that have been assembled and sleeving the upper axial magnetic sheet and each tile-shaped magnet that have been assembled around the small-diameter section firstly, then, sleeving the lower axial magnetic sheet around the small-diameter section, and then sleeving the upper lantern ring in a direction from the small-diameter section towards the large-diameter section to press the lower axial magnetic sheet against the lower axial side surface of each tile-shaped magnet, such that the lower axial magnetic sheet is secured with each tile-shaped magnet; and S6, pushing the upper axial magnetic sheet, the upper lower axial magnetic sheet and each tile-shaped magnet that have been assembled out of the small-diameter section.

Preferably, the radial magnetic circuit assembly method further includes: coating quick-drying type glue on the upper axial side surface of each tile-shaped magnet to enable the upper axial magnetic sheet to be secured with each tile-shaped magnet in the step S3; and coating quick-drying type glue on the lower axial side surface of each tile-shaped magnet type glue to enable the lower axial magnetic sheet to be secured with each tile-shaped magnet in the step S5.

Preferably, the quick-drying type glue is A/B glue or anaerobic glue.

Preferably, the radial magnetic circuit assembly method further includes: providing a sleeve and pushing the upper axial magnetic sheet and each tile-shaped magnet that have been assembled out of the small-diameter section through the sleeve in the step S4; and pushing the upper axial magnetic sheet, the upper lower axial magnetic sheet and each tile-shaped magnet that have been assembled out of the small-diameter section through the sleeve in the step S6.

Preferably, one end of the lower lantern ring is provided with a sealing plate, and one end of the large-diameter section abuts against an inner side of the sealing plate.

As compared to the prior art, the radial magnetic circuit assembly device provided by the embodiment of the present disclosure has the beneficial effects as follows: in assembling of the radial magnetic circuit assembly device, each tile-shaped magnet is annularly and uniformly arranged on the limit step formed at the joint of the large-diameter section and the small-diameter section firstly, then, the lower lantern ring is sleeved to limit the radial displacement of each tile-shaped magnet, then, the upper axial magnetic sheet is pressed against the upper axial side surface of each tile-shaped magnet through the upper lantern ring to enable each tile-shaped magnet to be secured with the upper axial magnetic sheet; finally, the upper axial magnetic sheet is turned over, and the lower axial magnetic sheet is pressed against the lower axial side surface of each tile-shaped magnet through the upper lantern ring to enable each tile-shaped magnet to be secured with the lower axial magnetic sheet. In this way, in the assembling process, even though a repulsive magnetic force is generated between each tile-shaped magnet and the upper axial magnetic sheet and the lower axial magnetic sheet, since each tile-shaped magnet is limited by the lower lantern ring and the upper lantern ring in the radial direction and in the axial direction, the processing difficulty may be effectively reduced, the production efficiency may be effectively improved in batch production, and therefore a large amount of manpower and assembly cost may be saved.

The radial magnetic circuit assembly method provided by the embodiment of the present disclosure has the beneficial effects as follows: in assembling of the radial magnetic circuit assembly device, each tile-shaped magnet is annularly and uniformly arranged on the limit step formed at the joint of the large-diameter section and the small-diameter section firstly, then, the lower lantern ring is sleeved to limit the radial displacement of each tile-shaped magnet, then, the upper axial magnetic sheet is pressed against the upper axial side surface of each tile-shaped magnet through the upper lantern ring to enable each tile-shaped magnet to be secured with the upper axial magnetic sheet; finally, the upper axial magnetic sheet is turned over, and the lower axial magnetic sheet is pressed against the lower axial side surface of each tile-shaped magnet through the upper lantern ring to enable each tile-shaped magnet to be secured with the lower axial magnetic sheet. In this way, in the assembling process, even though a repulsive magnetic force is generated between each tile-shaped magnet and the upper axial magnetic sheet and the lower axial magnetic sheet, since each tile-shaped magnet is limited by the lower lantern ring and the upper lantern ring in the radial direction and in the axial direction, the processing difficulty may be effectively reduced, the production efficiency may be effectively improved in batch production, and therefore a large amount of manpower and assembly cost may be saved.

Figure 1:
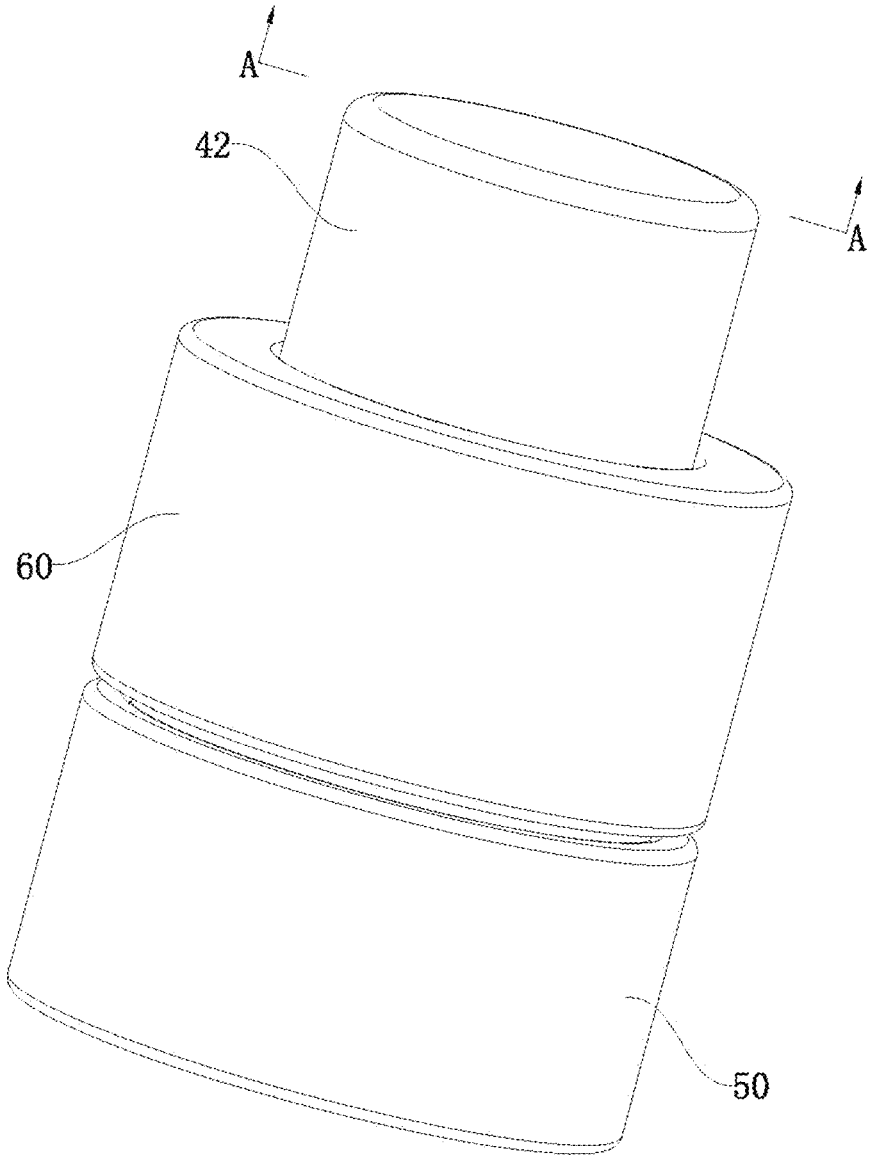
FIG. 1 depicts a schematic structural diagram of a radial magnetic circuit assembly device provided by an embodiment of the present disclosure.
Figure 2:
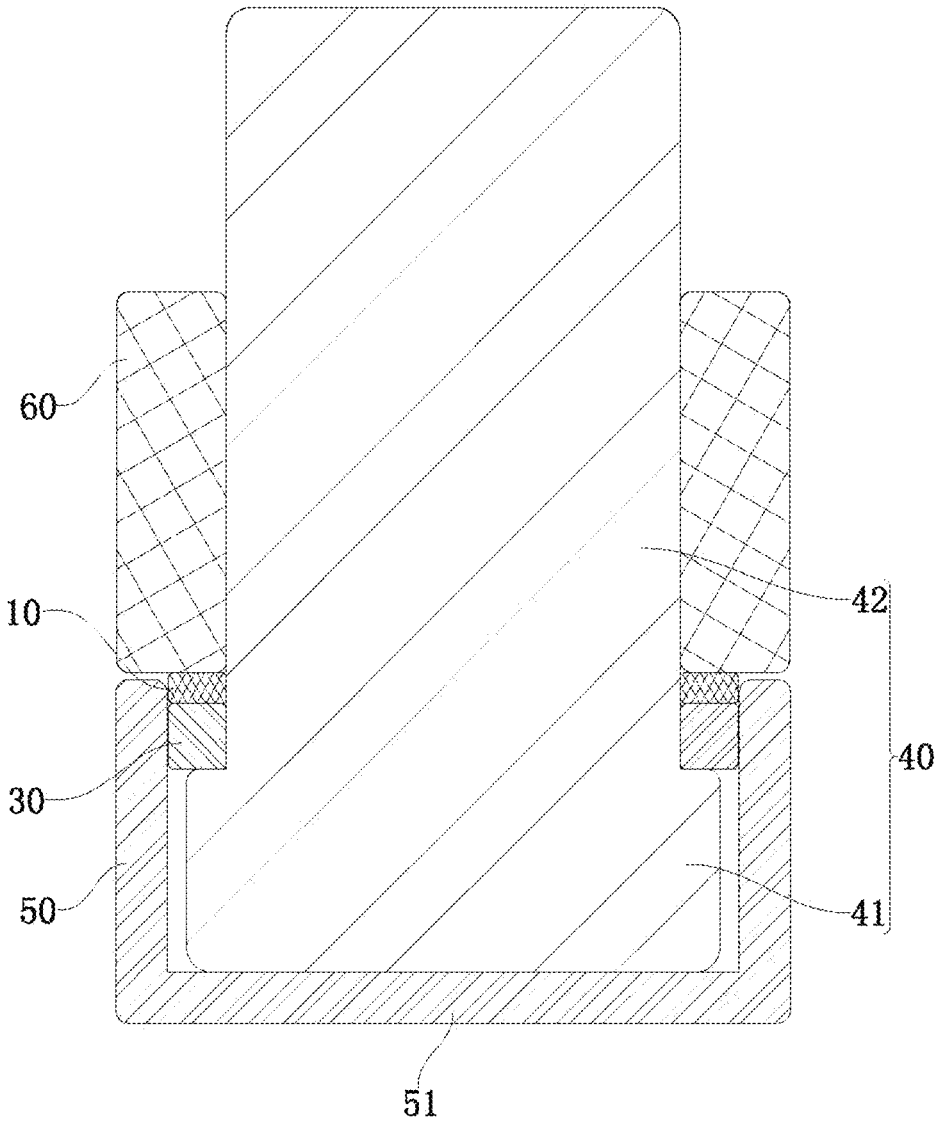
FIG. 2 depicts a cross-sectional diagram along line A-A in FIG. 1.
Figure 3:
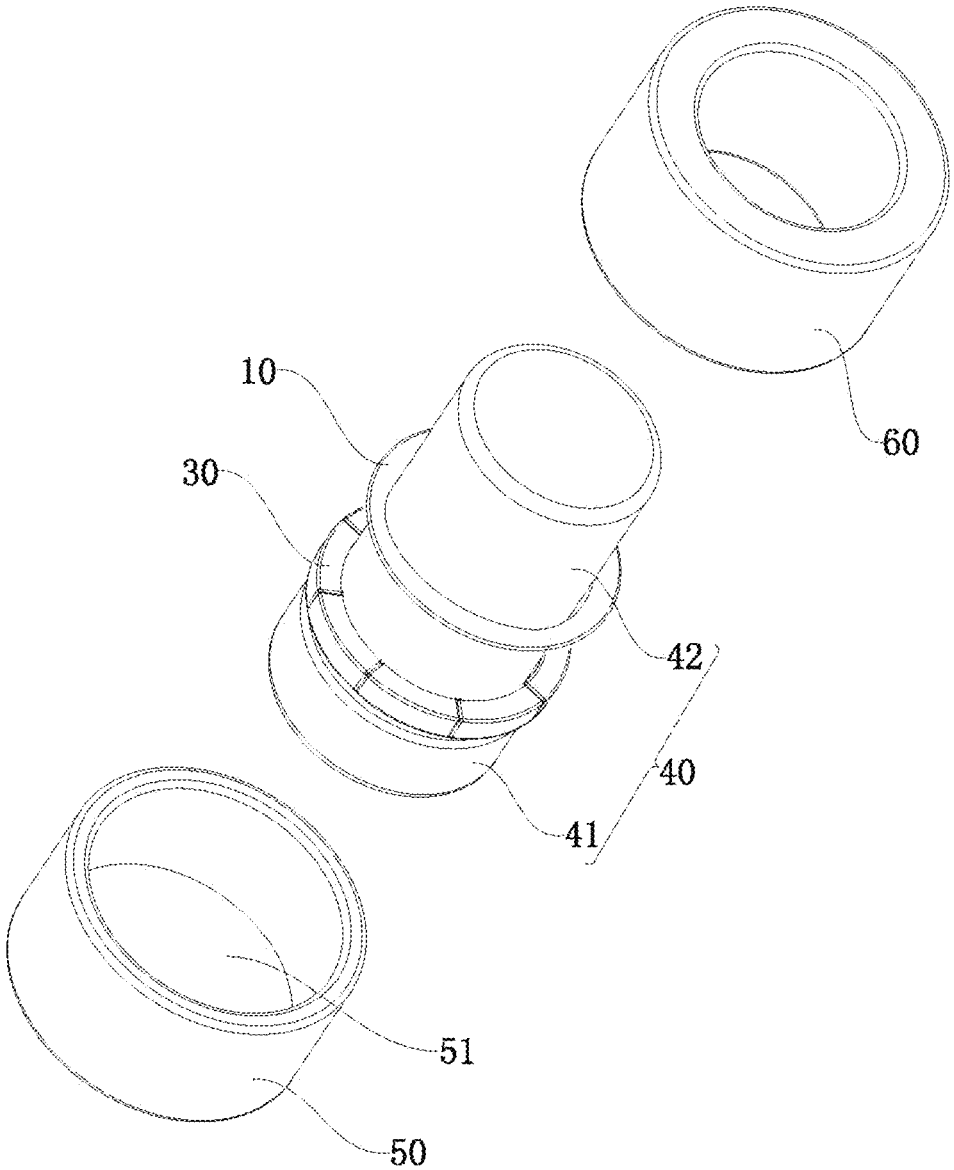
FIG. 3 depicts a schematic structural exploded view of the radial magnetic circuit assembly device provided by an embodiment of the present disclosure.

| Reference numerals include: | | |
|---|---|---|
| 10 - upper axial magnetic sheet | 20 - lower axial magnetic sheet | 30 - tile-shaped magnet |
| 40 - magnetic central column | 41 - large-diameter section | 42 - small-diameter section |
| 43 - limit step | 50 - lower lantern ring | 51 - sealing plate |
| 60 - upper lantern ring | 70 - sleeve | |

DETAILED DESCRIPTION

Herein, embodiments of the present disclosure are described in detail, and examples of the embodiment are illustrated in the accompanying figures; wherein, an always unchanged reference number or similar reference numbers represent(s) identical or similar components or components having identical or similar functionalities. The embodiment described below with reference to the accompanying figures is illustrative and intended to illustrate the present disclosure, but should not be considered as any limitation to the present disclosure.

In the description of the present disclosure, it needs to be understood that, directions or location relationships indicated by terms such as "length", "width", "up", "down", "front", "rear", "left", "right", "vertical", "horizontal", "top", "bottom", "inside", "outside", and so on are the directions or location relationships shown in the accompanying figures, which are only intended to describe the present disclosure conveniently and simplify the description, but not to indicate or imply that an indicated device or component must have specific locations or be constructed and manipulated according to specific locations; therefore, these terms shouldn't be considered as any limitation to the present disclosure.

In addition, terms "the first" and "the second" are only used in describe purposes, and should not be considered as indicating or implying any relative importance, or impliedly indicating the number of indicated technical features. As such, technical feature(s) restricted by "the first" or "the second" can explicitly or impliedly comprise one or more such technical feature(s). In the description of the present disclosure, "a plurality of" means two or more, unless there is additional explicit and specific limitation.

In the present disclosure, unless there is additional explicit stipulation and limitation, terms such as "mount", "connect with each other", "connect", "fix", and so on should be generalizedly interpreted, for example, "connect" can be interpreted as being fixedly connected, detachably connected, or connected integrally; "connect" can also be interpreted as being mechanically connected or electrically connected; "connect" can be further interpreted as being directly connected or indirectly connected through intermediary, or being internal communication between two components or an interaction relationship between the two components. For the one of ordinary skill in the art, the specific meanings of the aforementioned terms in the present disclosure can be interpreted according to specific conditions.

As shown in FIGS. 1-6, a radial magnetic circuit assembly device is provided in an embodiment of the present disclosure, the radial magnetic circuit is configured to respectively mount an upper axial magnetic sheet 10 and a lower axial magnetic sheet 20 on an upper axial side surface (not shown) and a lower axial side surface (not shown) of a plurality of tile-shaped magnets 30; the radial magnetic circuit assembly device includes a magnetic central column 40, a lower sleeve lantern ring 50 and an upper sleeve lantern ring 60 sleeved on the magnetic central column 40, the magnetic central column 40 includes a large-diameter section 41 and a small-diameter section 42 connected in sequence, a joint of the large-diameter section 41 and the small-diameter section 42 is provided with a limit step 43 on which the tile-shaped magnets 30 are annularly and uniformly arranged, the lower lantern ring 50 is sleeved on the tile-shaped magnet 30 in a direction from the large-diameter section 41 towards the small-diameter section 42 and is configured to limit a radial displacement of each tile-shaped magnet 30, the upper sleeve lantern ring 60 is sleeved in a direction from the small-diameter section 42 towards the large-diameter section 41, such that the upper axial magnetic sheet 10 and the lower axial magnetic sheet 20 are respectively pressed against the upper axial side surface and the lower axial side surface of each tile-shaped magnet 30.

Particularly, in assembling of the radial magnetic circuit assembly device in the embodiment of the present disclosure, each tile-shaped magnet 30 is annularly and uniformly arranged on the limit step 43 formed at the joint of the large-diameter section 41 and the small-diameter section 42 firstly, then, the lower lantern ring 50 is sleeved to limit the radial displacement of each tile-shaped magnet 30; or alternatively, the lower lantern ring 50 may be sleeved on the large-diameter section 41, then, each tile-shaped magnet 30 is annularly and uniformly arranged in the space formed between the limit step 43 and the lower sleeve lantern ring 50, in this way, limiting of the radial displacement of each tile-shaped magnet 30 is realized through the lower lantern ring 50. Then, the upper axial magnetic sheet 10 is pressed against the upper axial side surface of each tile-shaped magnet 30 through the upper lantern ring 60 to enable each tile-shaped magnet 30 to be secured with the upper axial magnetic sheet 10; finally, the upper axial magnetic sheet 10 is turned over, and the lower axial magnetic sheet 20 is pressed against the lower axial side surface of each tile-shaped magnet 30 through the upper lantern ring 60 to enable each tile-shaped magnet 30 to be secured with the lower axial magnetic sheet 20. In this way, in the assembling process, even though a repulsive magnetic force is generated between each tile-shaped magnet 30 and the upper axial magnetic sheet 10 and the lower axial magnetic sheet 20, since each tile-shaped magnet 30 is limited by the lower lantern ring 50 and the upper lantern ring 60 in the radial direction and in the axial direction, the processing difficulty may be effectively reduced, the production efficiency may be effectively improved in batch production, and therefore a large amount of manpower and assembly cost may be saved.

Figure 4:
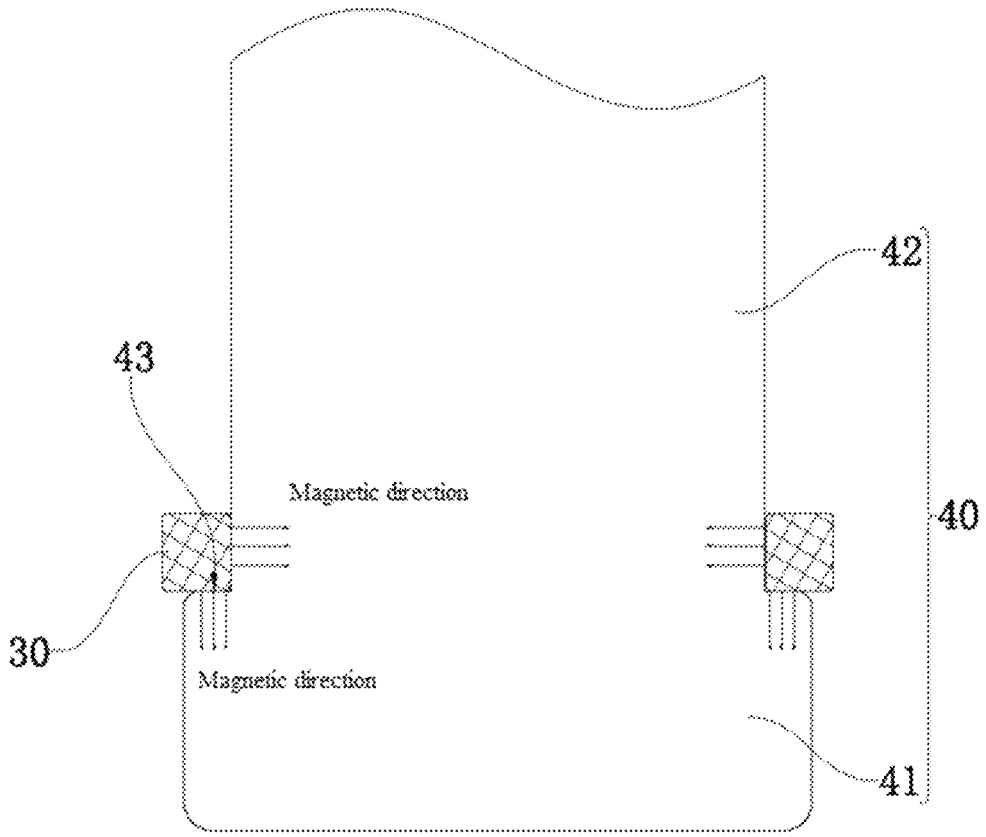
FIG. 4 depicts a schematic structural diagram of assembling each tile-shaped magnet with a magnetic central column in a radial magnetic circuit assembly method provided by an embodiment of the present disclosure.
Figure 5:
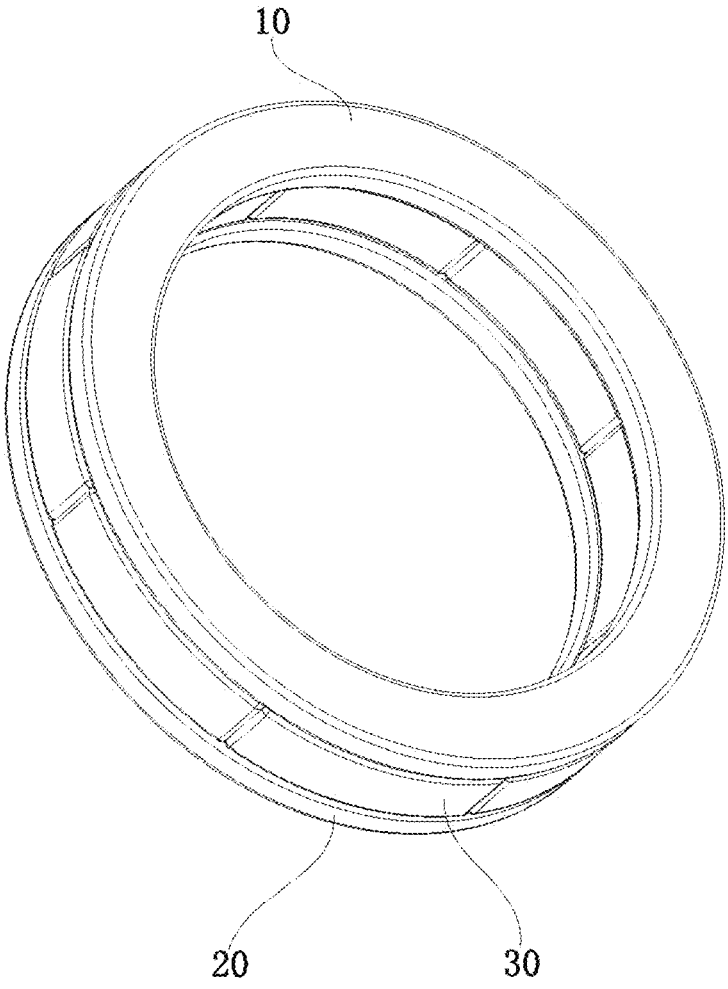
FIG. 5 depicts a schematic structural diagram of an upper axial magnetic sheet, a lower axial magnetic sheet and each tile-shaped magnet which have been assembled according to the radial magnetic circuit assembly method provided by the embodiment of the present disclosure.

As shown in FIG. 4, it needs be further noted that, a radial magnetizing needs to be performed on each tile-shaped magnet 30 before assembly of the tile-shaped magnet 30, the arrows indicate the directions of the magnetic fields of each tile-shaped magnet 30, when each tile-shaped magnet 30 is mounted on the limit step 43, the tile-shaped magnet 30 may also connected with the small-diameter section 42 in magnetically attractive manner.

The magnetic central column 40 is preferably made of a soft magnetic material such as low-carbon steel.

In this embodiment, one end of the lower sleeve lantern ring 50 is provided with a sealing plate 51, and an end of the large-diameter section 41 abuts against an inner side of the sealing plate 51. Particularly, when the lower lantern ring 50 is sleeved on the tile-shaped magnet 30 in the direction from the large-diameter section 41 towards the small-diameter section 42, there is no need to control the depth of sleeving of the lower lantern ring 50, the lower lantern ring 50 is directly pushed until the inner side of the sealing plate 51 of the lower lantern ring 50 abuts against the end of the large-diameter section 41, thus, the assembling efficiency is higher, and the assembling accuracy may also be guaranteed. Preferably, the sealing plate 51 and the lower sleeve lantern ring 50 are designed to be integrally shaped.

Figure 6:
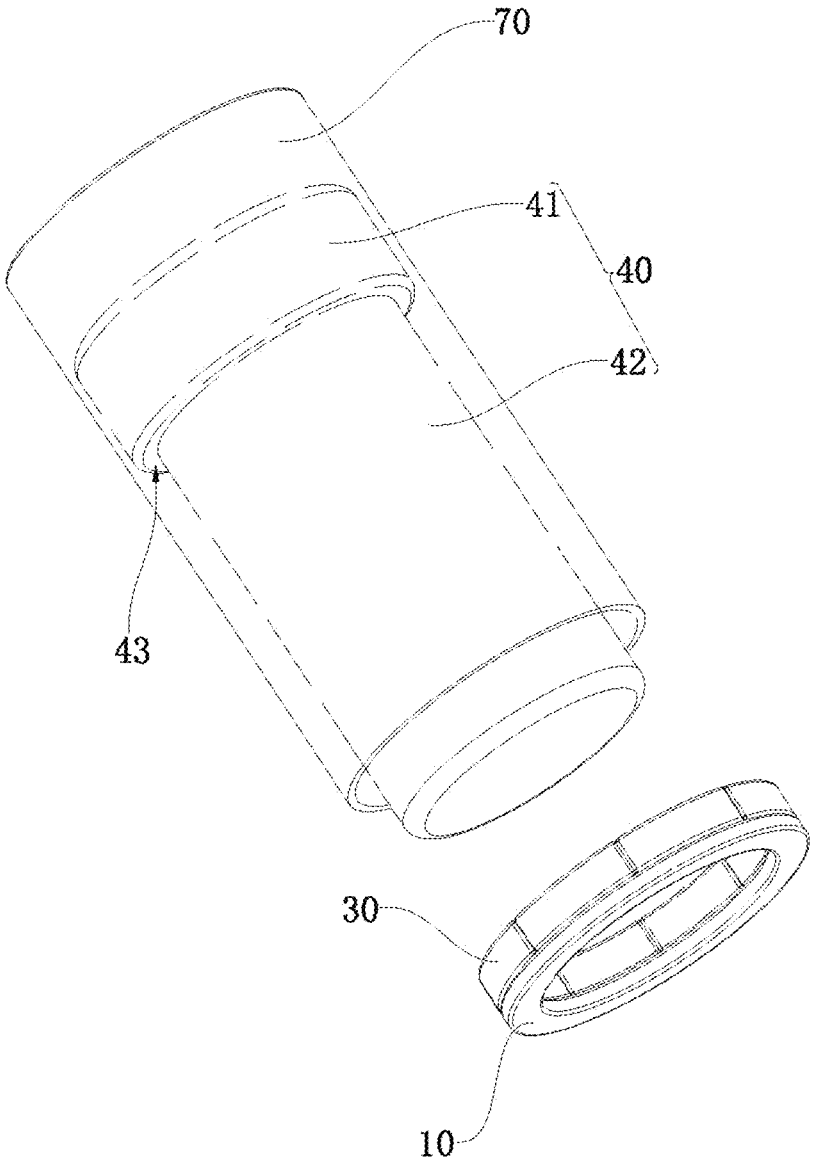
FIG. 6 depicts a schematic structural diagram of pushing the upper axial magnetic sheet and each tile-shaped magnet out of the magnetic central column through a sleeve after the upper axial magnetic sheet and the tile-shaped magnet are assembled according to the radial magnetic circuit assembly method provided by the embodiment of the present disclosure.

In this embodiment, as shown in FIG. 6, the radial magnetic circuit assembly device further includes a sleeve 70 configured to push the upper axial magnetic sheet 10 and the tile-shaped magnet 30 that have been assembled out of the small-diameter section 42, and to push the upper axial magnetic sheet 10, the lower axial magnetic sheet 20 and the tile-shaped magnet 30 that have been assembled out of the small-diameter section 42. Particularly, due to the fact that the upper axial magnetic sheet 10 and the lower axial magnetic sheet 20 need to be assembled with the upper axial side surface and the lower axial side surface of the annularly and uniformly arranged tile-shaped magnet 30 respectively, the upper axial magnetic sheet 10 and each tile-shaped magnet 30 need to be taken out after the assembling of the upper axial direction magnetic sheet 10 and the upper axial side surface of each tile-shaped magnet 30 is completed; at this moment, the upper axial magnetic sheet 10 and each tile-shaped magnet 30 are pushed by the sleeve 70 until the upper axial magnetic sheet 10 and each tile-shaped magnet 30 are separated from the small-diameter section 42; the upper axial magnetic sheet 10 is turned over, each tile-shaped magnet 30 connected with the upper axial magnetic sheet 10 is also turned over simultaneously, then, the upper axial magnetic sheet 10 is sleeved on the small-diameter section 42 until the upper axial magnetic sheet 10 is abutted against the limit step 43; at this moment, the assembling of the lower axial magnetic sheet 20 is further performed, the method of assembling the lower axial magnetic sheet 20 is the same as the method of assembling the upper axial magnetic sheet 10, it is not repeatedly described here.

Preferably, the assembly and connection between the upper axial magnetic sheet 10, the lower axial magnetic sheet 20 and each tile-shaped magnet 30 may be implemented by quick-drying type glue, such as A/B glue or anaerobic glue.

In this embodiment, the lower lantern ring 50 is a non-metal upper lantern ring 50, and the upper lantern ring 60 is a non-metal upper lantern ring. Particularly, the lower lantern ring 50 and the upper lantern ring 60 are made of non-metallic materials, so that they may be avoided from being mutually magnetically attracted with the tile-shaped magnet 30, the upper axial magnetic sheet 10 and the lower axial magnetic sheet 20, in this way, a free assembly and disassembly of the lower lantern ring 50 and the upper lantern ring 60 may be guaranteed, and the assembling is performed successfully.

In this embodiment, particularly, the non-metal lower lantern ring 50 is a plastic lower lantern ring, and the non-metal upper lantern ring 60 is a plastic upper lantern ring. The lower lantern ring 50 and the upper lantern ring 60 which are made of the plastic material are lighter in weight, are prone to be manufactured, and are lower in cost.

Preferably, the magnetic central column 40 is a soft magnetic central column.

More preferably, the soft magnetic central column is a low-carbon steel central column.

Embodiments of the present disclosure further provide a radial magnetic circuit assembly method which includes following steps:

S1, providing a magnetic central column 40, where the magnetic central column 40 includes a large-diameter section 41 and a small-diameter section 42 connected in sequence, and a limit step 43 is formed at a joint of the large-diameter section 41 and the small-diameter section 42;

S2, providing a lower lantern ring 50, annularly and uniformly arranging a plurality of tile-shaped magnets 30 on the limit step 43 firstly, and then sleeving the lower lantern ring 50 around the tile-shaped magnet 30 in the direction from the large-diameter section 41 towards the small-diameter section 42 to limit a radial displacement of each tile-shaped magnet 30; or alternatively, sleeving the lower lantern ring 50 around the large-diameter section 42 in the direction from the large-diameter section 41 towards the small-diameter section 42 firstly, and then annularly and uniformly arranging each tile-shaped magnet 30 in the space formed between the limit step 43 and the lower lantern ring 50, such that the lower lantern ring 50 limits a radial displacement of each tile-shaped magnet 30;

S3, providing an upper lantern ring 60, sleeving the upper axial magnetic sheet 10 around the small-diameter section 42 firstly, then, sleeving the upper sleeve lantern ring 60 in the direction from the small-diameter section 42 towards the large-diameter section 41 to press the upper axial magnetic sheet 10 against the upper axial side surface of each tile-shaped magnet 30, such that the upper axial magnetic sheet 10 is secured with each tile-shaped magnet 30;

S4, pushing the upper axial magnetic sheet 10 and each tile-shaped magnet 30 that have been assembled out of the small-diameter section 42;

S5, turning over the upper axial magnetic sheet 10 and each tile-shaped magnet 30 that have been assembled firstly, then, sleeving the lower axial magnetic sheet 20 around the small-diameter section 42, and then sleeving the upper sleeve lantern ring 60 around the small-diameter section 42 in the direction from the small-diameter section 42 towards the large-diameter section 41 to press the lower axial magnetic sheet 20 against the lower axial side surface of each tile-shaped magnet 30, such that the lower axial magnetic sheet 20 is secured with each tile-shaped magnet 30; and S6, pushing the upper axial magnetic sheet 10, the lower axial magnetic sheet 20 and each tile-shaped magnet 30 that have been assembled out of the small-diameter section 42.

In assembling of the radial magnetic circuit assembly device in the embodiment of the present disclosure, each tile-shaped magnet 30 is annularly and uniformly arranged on the limit step 43 formed at the joint of the large-diameter section 41 and the small-diameter section 42 firstly, then, the lower lantern ring 50 is sleeved to limit the radial displacement of each tile-shaped magnet 30; or alternatively, the lower lantern ring 50 may be sleeved on the large-diameter section 41, then, each tile-shaped magnet 30 is annularly and uniformly arranged in the space formed between the limit step 43 and the lower sleeve lantern ring 50, in this way, limiting of the radial displacement of each tile-shaped magnet 30 is realized through the lower lantern ring 50. Then, the upper axial magnetic sheet 10 is pressed against the upper axial side surface of each tile-shaped magnet 30 through the upper lantern ring 60 to enable each tile-shaped magnet 30 to be secured with the upper axial magnetic sheet 10; finally, the upper axial magnetic sheet 10 is turned over, and the lower axial magnetic sheet 20 is further pressed against the lower axial side surface of each tile-shaped magnet 30 through the upper lantern ring 60 to enable each tile-shaped magnet 30 to be secured with the lower axial magnetic sheet 20. In this way, in the assembling process, even though a repulsive magnetic force is generated between each tile-shaped magnet 30 and the upper axial magnetic sheet 10 and the lower axial magnetic sheet 20, due to the fact that each tile-shaped magnet 30 is limited by the lower lantern ring 50 and the upper lantern ring 60 in the radial direction and in the axial direction, the processing difficulty may be effectively reduced, the production efficiency may be effectively improved in batch production, and therefore a large amount of manpower and assembly cost may be saved.

In this embodiment, in the step S3, a quick-drying type glue is coated on the upper axial side surface of each tile-shaped magnet 30, such that the upper axial magnetic sheet 10 is secured with each tile-shaped magnet 30; in the step S5, the quick-drying type glue is coated on the lower axial side surface of each tile-shaped magnet 30, such that the lower axial magnetic sheet 20 is secured with each tile-shaped magnet 30. Particularly, the upper axial magnetic sheet 10 and the lower axial magnetic sheet 20 are fixedly connected with each tile-shaped magnet 30 through the quick-drying type glue, not only quick assembly may be realized, but also the stability of the connection between the upper axial magnetic sheet 10, the lower axial magnetic sheet 20 and each tile-shaped magnet 30 that have been assembled is excellent.

In this embodiment, the quick-drying type glue is preferably A/B glue or anaerobic glue. Of course, in other embodiments, the quick-drying type glue may also be yellow glue or white glue.

In this embodiment, in the step S4, a sleeve 70 is provided, and the upper axial magnetic sheet 10 and each tile-shaped magnet 30 that have been assembled are pushed out of the small-diameter section 42 through the sleeve 70; in the step S6, the upper axial magnetic sheet 10, the lower axial magnetic sheet 20 and each tile-shaped magnet 30 that have been assembled are pushed out of the small-diameter section 42 through the sleeve 70. Particularly, since the upper axial magnetic sheet 10 and the lower axial magnetic sheet 20 need to be assembled with the upper axial side surface and the lower axial side surface of the annularly and uniformly arranged tile-shaped magnet 30 respectively, the upper axial magnetic sheet 10 and each tile-shaped magnet 30 need to be taken out after assembling of the upper axial direction magnetic sheet 10 and the upper axial side surface of each tile-shaped magnet 30 is completed; at this moment, the upper axial magnetic sheet 10 and each tile-shaped magnet 30 are pushed by the sleeve 70 until the upper axial magnetic sheet 10 and each tile-shaped magnet 30 are separated from the small-diameter section 42; the upper axial magnetic sheet 10 is turned over, each tile-shaped magnet 30 connected with the upper axial magnetic sheet 10 is also turned over simultaneously, then, the upper axial magnetic sheet 10 is sleeved on the small-diameter section 42 until the upper axial magnetic sheet 10 is abutted against the limit step 43, at this moment, the assembling of the lower axial magnetic sheet 20 is further performed, the method of assembling the lower axial magnetic sheet 20 is the same as the method of assembling the upper axial magnetic sheet 10, it is not repeatedly described here.

In this embodiment, one end of the lower sleeve lantern ring 50 is provided with a sealing plate 51, and an end of the large-diameter section 41 abuts against an inner side of the sealing plate 51. Particularly, when the lower lantern ring 50 is sleeved on the tile-shaped magnet 30 in the direction from the large-diameter section 41 to the small-diameter section 42, there is no need to control the depth of sleeving of the lower lantern ring 50, the lower lantern ring 50 is directly pushed until the inner side of the sealing plate 51 of the lower lantern ring 50 abuts against the end of the large-diameter section 41, thus, the assembling efficiency is higher, and the assembling accuracy may also be guaranteed. The sealing plate 51 and the lower sleeve lantern ring 50 are preferably designed to be integrally shaped.

It is obvious from what stated above that the present disclosure has the aforesaid excellent features, such that the present disclosure increases efficiencies not included in the prior art and possesses practicability in use, and thus become a product having great practical value.

The aforementioned embodiments are only preferred embodiments of the present disclosure, and should not be regarded as being limitation to the present disclosure. Any modification, equivalent replacement, improvement, and the like, which are made within the spirit and the principle of the present disclosure, should all be included in the protection scope of the present disclosure.

What is claimed is:

1. A radial magnetic circuit assembly device configured to mount an upper axial magnetic sheet and a lower axial magnetic sheet, respectively, on an upper axial side surface and a lower axial side surface of each of a plurality of tile-shaped magnets, comprising:

a magnetic central column, and a lower lantern ring and an upper lantern ring sleeved on the magnetic central column, wherein the magnetic central column comprises a large-diameter section and a small-diameter section connected in sequence, a joint of the large-diameter section and the small-diameter section is provided with a limit step on which each tile-shaped magnet is annularly and uniformly arranged, the lower lantern ring is sleeved on the tile-shaped magnet in a direction from the large-diameter section towards the small-diameter section and is configured to limit a radial displacement of each tile-shaped magnet, and the upper lantern ring is sleeved on the tile-shaped magnet in a direction from the small-diameter section towards the large-diameter section to press the upper axial magnetic sheet and the lower axial magnetic sheet against the upper axial side surface and the lower axial side surface of each tile-shaped magnet, respectively.

2. The radial magnetic circuit assembly device according to claim 1, wherein one end of the lower lantern ring is provided with a sealing plate, and one end of the large-diameter section abuts against an inner side of the sealing plate.

3. The radial magnetic circuit assembling device according to claim 1, further comprising a sleeve configured to push the upper axial magnetic sheet and the tile-shaped magnet that have been assembled out of the small-diameter section, and to push the upper axial magnetic sheet, the lower axial magnetic sheet and the tile-shaped magnet that have been assembled out of the small-diameter section.

4. The radial magnetic circuit assembly device according to claim 1, wherein the lower lantern ring is a non-metal lower lantern ring, and the upper lantern ring is a non-metal upper lantern ring.

5. The radial magnetic circuit assembly device according to claim 1, wherein the lower lantern ring is a plastic lower lantern ring, and the upper lantern ring is a plastic upper lantern ring.

6. The radial magnetic circuit assembly device according to claim 1, wherein the magnetic central column is a soft magnetic central column.

7. The radial magnetic circuit assembly device according to claim 1, wherein the magnetic central column is a low carbon steel magnetic central column.

8. A radial magnetic circuit assembly method, comprising the steps of:

S1, providing a magnetic central column, wherein the magnetic central column comprises a large-diameter section and a small-diameter section connected in sequence, and a limit step is formed at a joint of the large-diameter section and the small-diameter section;

S2, providing a lower lantern ring, annularly and uniformly arranging a plurality of tile-shaped magnets on the limit step first, and then sleeving the lower lantern ring around the tile-shaped magnet in a direction from the large-diameter section towards the small-diameter section to limit a radial displacement of each tile-shaped magnet; or alternatively, sleeving the lower lantern ring around the large-diameter section in a direction from the large-diameter section towards the small-diameter section, and then annularly and uniformly arranging each tile-shaped magnet in a space formed between the limit step and the lower lantern ring, such that the lower lantern ring limits a radial displacement of each tile-shaped magnet;

S3, providing an upper lantern ring, sleeving an upper axial magnetic sheet around the small-diameter section first, and then sleeving the upper lantern ring around the tile-shaped magnet in the direction from the small-diameter section towards the large-diameter section to press the upper axial magnetic sheet against an upper axial side surface of each tile-shaped magnet, such that the upper axial magnetic sheet is secured with each tile-shaped magnet;

S4, pushing the upper axial magnetic sheet and each tile-shaped magnet that have been assembled out of the small-diameter section;

S5, turning over the upper axial magnetic sheet and each tile-shaped magnet that have been assembled and sleeving the upper axial magnetic sheet and each tile-shaped magnet that have been assembled around the small-diameter section first, then, sleeving the lower axial magnetic sheet around the small-diameter section, and then sleeving the upper lantern ring in a direction from the small-diameter section towards the large-diameter section to press the lower axial magnetic sheet against the lower axial side surface of each tile-shaped magnet, such that the lower axial magnetic sheet is secured with each tile-shaped magnet; and S6, pushing the upper axial magnetic sheet, the upper lower axial magnetic sheet and each tile-shaped magnet that have been assembled out of the small-diameter section.

9. The radial magnetic circuit assembly method according to claim 8, further comprising: coating quick-drying type glue on the upper axial side surface of each tile-shaped magnet to enable the upper axial magnetic sheet to be secured with each tile-shaped magnet in step S3; and coating quick-drying type glue on the lower axial side surface of each tile-shaped magnet type glue to enable the lower axial magnetic sheet to be secured with each tile-shaped magnet in step S5.

10. The radial magnetic circuit assembly method according to claim 9, wherein the quick-drying type glue is A/B glue or anaerobic glue.

11. The radial magnetic circuit assembly method according to claim 8, further comprising: providing a sleeve and pushing the upper axial magnetic sheet and each tile-shaped magnet that have been assembled out of the small-diameter section through the sleeve in step S4; and pushing the upper axial magnetic sheet, the upper lower axial magnetic sheet and each tile-shaped magnet that have been assembled out of the small-diameter section through the sleeve in step S6.

12. The radial magnetic circuit assembly method according to claim 8, wherein one end of the lower lantern ring is provided with a sealing plate, and one end of the large-diameter section abuts against an inner side of the sealing plate.

* * * * *